US008721510B2

(12) United States Patent
Chung-Ting et al.

(10) Patent No.: US 8,721,510 B2
(45) Date of Patent: May 13, 2014

(54) FOLDABLE SKATEBOARDING FITNESS EQUIPMENT

(76) Inventors: Tseng Chung-Ting, Taipei (TW); Wei-Yu Ho, Taipei (TW)

( * ) Notice: Subject to any disclaimer, the term of this patent is extended or adjusted under 35 U.S.C. 154(b) by 182 days.

(21) Appl. No.: 13/317,349

(22) Filed: Oct. 17, 2011

(65) Prior Publication Data

US 2013/0095981 A1 Apr. 18, 2013

(51) Int. Cl.

| | |
|---|---|
| ***A63B 22/14*** | (2006.01) |
| ***A63B 22/18*** | (2006.01) |
| ***A63B 22/20*** | (2006.01) |

(52) U.S. Cl.

USPC ..... 482/140; 482/132; 482/142

(58) Field of Classification Search

CPC ..... A63B 2022/206; A63B 2022/201; A63B 2022/20; A63B 22/0087

USPC ..... 482/146, 51, 142, 147, 71, 79, 132, 66, 482/68, 80, 9

See application file for complete search history.

(56) References Cited

U.S. PATENT DOCUMENTS

| | | | | |
|---|---|---|---|---|
| 2,251,120 | A * | 7/1941 | Davis | 482/73 |
| 4,723,774 | A * | 2/1988 | Monforte | 482/72 |
| 5,000,469 | A * | 3/1991 | Smith | 280/261 |
| 5,232,423 | A * | 8/1993 | Hajduczek | 482/68 |
| 5,575,740 | A * | 11/1996 | Piaget et al. | 482/70 |
| D397,745 | S * | 9/1998 | Wu | D21/668 |
| 7,022,052 | B1 * | 4/2006 | Lai | 482/72 |
| 7,229,388 | B2 * | 6/2007 | Yang | 482/72 |
| 7,361,124 | B1 * | 4/2008 | Chung-Ting | 482/72 |
| D584,367 | S * | 1/2009 | Augustine et al. | D21/662 |
| 7,611,445 | B2 * | 11/2009 | Brown et al. | 482/51 |
| D631,519 | S * | 1/2011 | Chen | D21/689 |
| 8,113,997 | B2 * | 2/2012 | Fernandez et al. | 482/71 |
| 2008/0064577 | A1 * | 3/2008 | Pederson et al. | 482/140 |

* cited by examiner

*Primary Examiner* — Oren Ginsberg
*Assistant Examiner* — Rae Fischer
(74) *Attorney, Agent, or Firm* — Jackson IPG PLLC

(57) ABSTRACT

The present invention discloses a foldable skateboarding fitness equipment having a dual-rail track bar in a circular arc shape and slidably sheathed on a cushion frame by a pulley, a turnable cushion seat pivotally coupled to the cushion frame by a ball bearing, a front support frame of an elbow support cushion fixed separately on both sides of the top of the track bar by a pivoting base, a link rod pivotally coupled between the bottom of the front support frame and the top of the track bar, such that a user can kneel on the cushion seat and push the cushion seat to drive the cushion frame to slide back and forth along the track bar, as well as contracting and bending the waist or abdomen to rotate the cushion seat to the left and the right.

4 Claims, 7 Drawing Sheets

FOLDABLE SKATEBOARDING FITNESS EQUIPMENT

BACKGROUND OF THE INVENTION

1. Field of the Invention

The present invention relates to a foldable skateboarding fitness equipment, in particular to fitness equipment having a dual-rail track bar in a circular arc shape and slidably sheathed on a cushion frame by a pulley, a turnable cushion seat pivotally coupled to the cushion frame by a ball bearing, a front support frame of an elbow support cushion attached separately on both sides of the top of the track bar by a pivoting base, a link rod pivotally coupled between the bottom of the front support frame and the top of the track bar, a support leg turnably adjusted and attached onto a rear support frame at the rear of the track bar to tilt with respect to a ground or floor, such that the front support frame can be used for adjusting the length passing through the pivoting base to tilt the fitness equipment with respect to the ground, and a user can kneel on the cushion seat and support the user's body by both elbows at the elbow support cushions, and use both knees and waist or abdomen to push the cushion seat to drive the cushion frame to slide back and forth along the track bar, as well as contracting and bending the waist or abdomen to rotate the cushion seat to the left and the right, and the rotation is limited by a stop member installed at an edge. This exercise simulates the skateboarding exercise and provides different advanced waist, abdomen, and hip training for different users, and the skateboarding fitness equipment can be folded vertically to reduce the storage volume.

2. Description of the Related Art

Due to unbalanced diets and insufficient exercise facilities, people place increasingly more emphases on health, and various fitness equipment is introduced into the market. However, most of the present existing exercise equipment seldom provides exercises for both waist and hips simultaneously. Even though there are some, they come with a high price, a heavy weight and a large volume and fail to meet the user requirements for different advanced levels of use for different users. Obviously, the conventional exercise equipment requires improvements.

SUMMARY OF THE INVENTION

In view of the shortcomings of the conventional exercise equipment, the inventor of the present invention based on years of experience in the related industry has conducted extensive research and experiments, and finally developed a foldable skateboarding fitness equipment to overcome the shortcomings of the prior art.

The present invention overcome the shortcomings of the prior art by providing a foldable skateboarding fitness equipment, having a dual-rail track bar in a circular arc shape and slidably sheathed on a cushion frame by a pulley, a turnable cushion seat pivotally coupled to the cushion frame by a ball bearing, a front support frame of an elbow support cushion attached separately on both sides of the top of the track bar by a pivoting base, a link rod pivotally coupled between the bottom of the front support frame and the top of the track bar, a support leg turnably adjusted and attached onto a rear support frame at the rear of the track bar to tilt with respect to a ground or floor, such that the front support frame can be used for adjusting the length passing through the pivoting base to tilt the fitness equipment with respect to the ground, and a user can kneel on the cushion seat and support the user's body by both elbows at the elbow support cushions, and use both knees and waist or abdomen to push the cushion seat to drive the cushion frame to slide back and forth along the track bar, as well as contracting and bending the waist or abdomen to rotate the cushion seat to the left and the right, and the rotation is limited by a stop member installed at an edge. This exercise simulates the skateboarding exercise and provides different advanced waist, abdomen, and hip training for different users, and the skateboarding fitness equipment can be folded vertically to reduce the storage volume.

It is a primary objective of the present invention is to provide a foldable skateboarding fitness equipment, having a support leg pivotably adjustable and attached onto the rear support frame, such that after the front support frame is folded, the fitness equipment can be erected to reduce the storage volume.

DETAILED DESCRIPTION OF THE PREFERRED EMBODIMENT

To understand the structure and effects of the present invention, preferred embodiments are described in details with the illustration of related drawings as follows.

Figure 3:
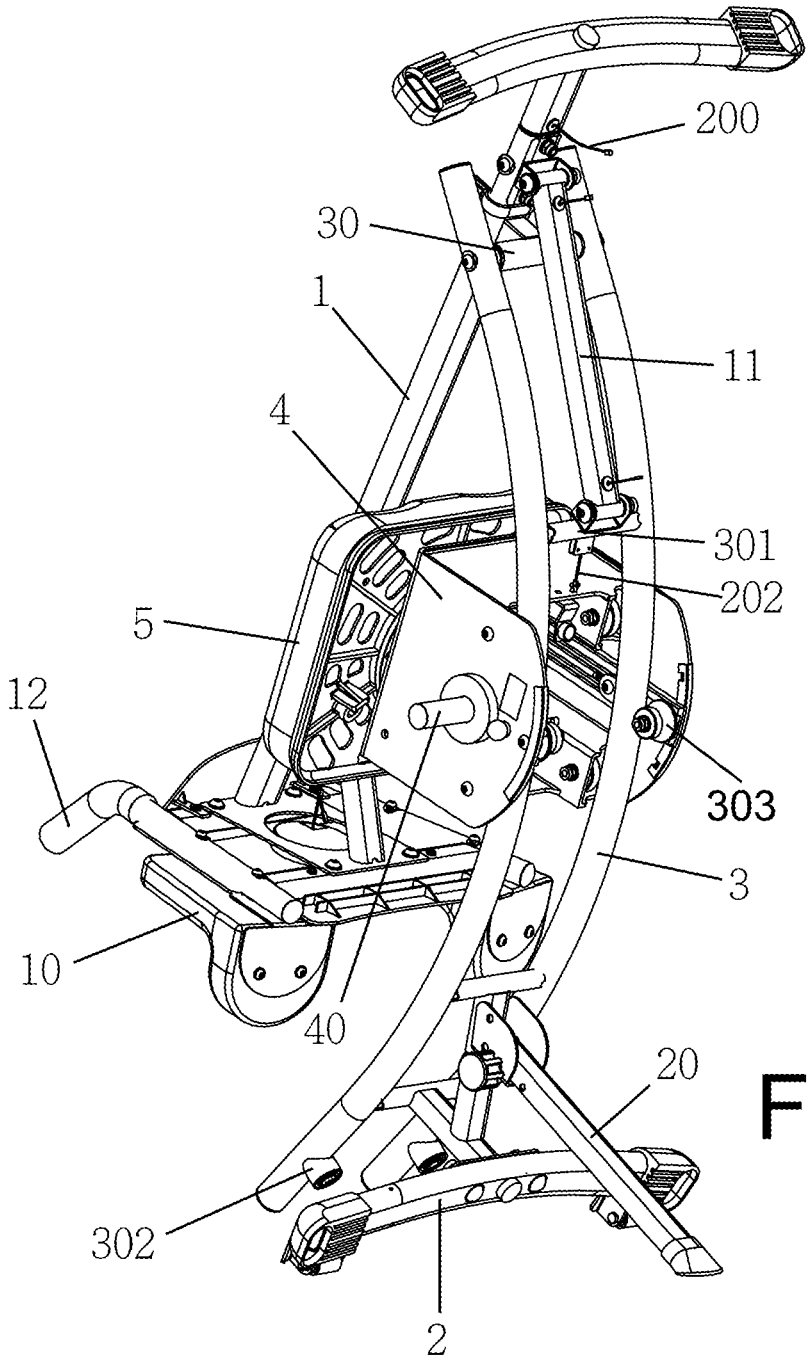
FIG. 3 is a schematic view of folding a skateboarding fitness equipment in accordance with a preferred embodiment of the present invention.
Figure 4:
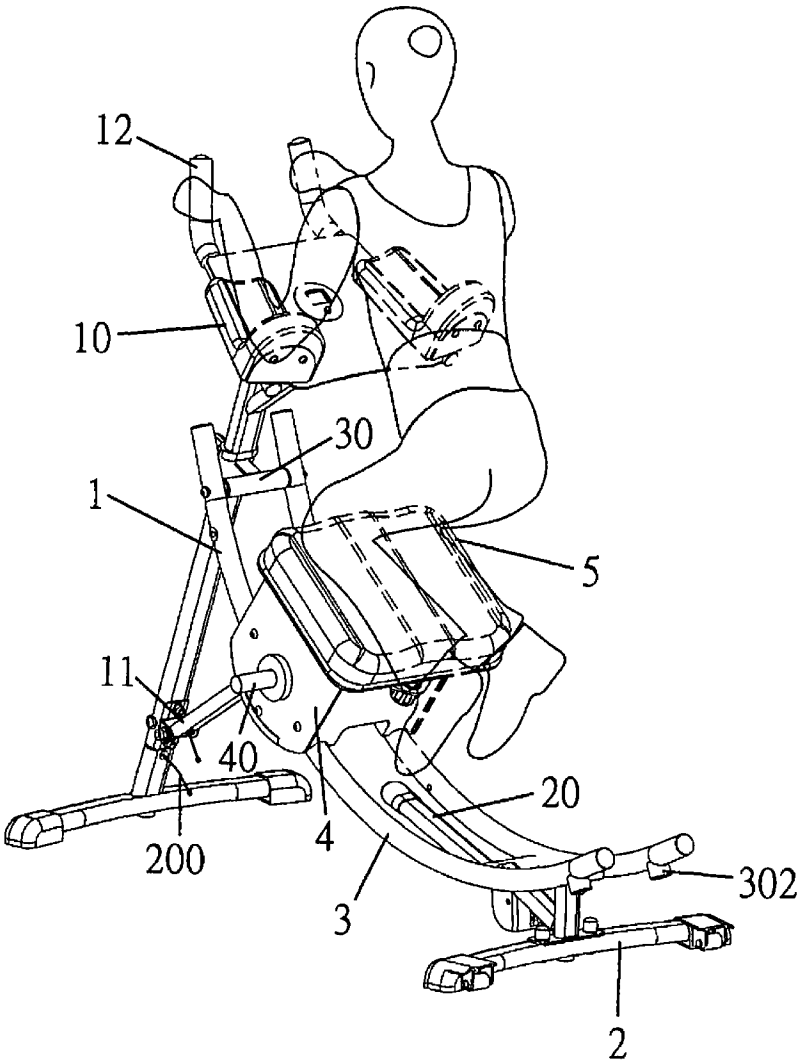
FIG. 4 is a schematic view of using a skateboarding fitness equipment in accordance with a preferred embodiment of the present invention.
Figure 5:
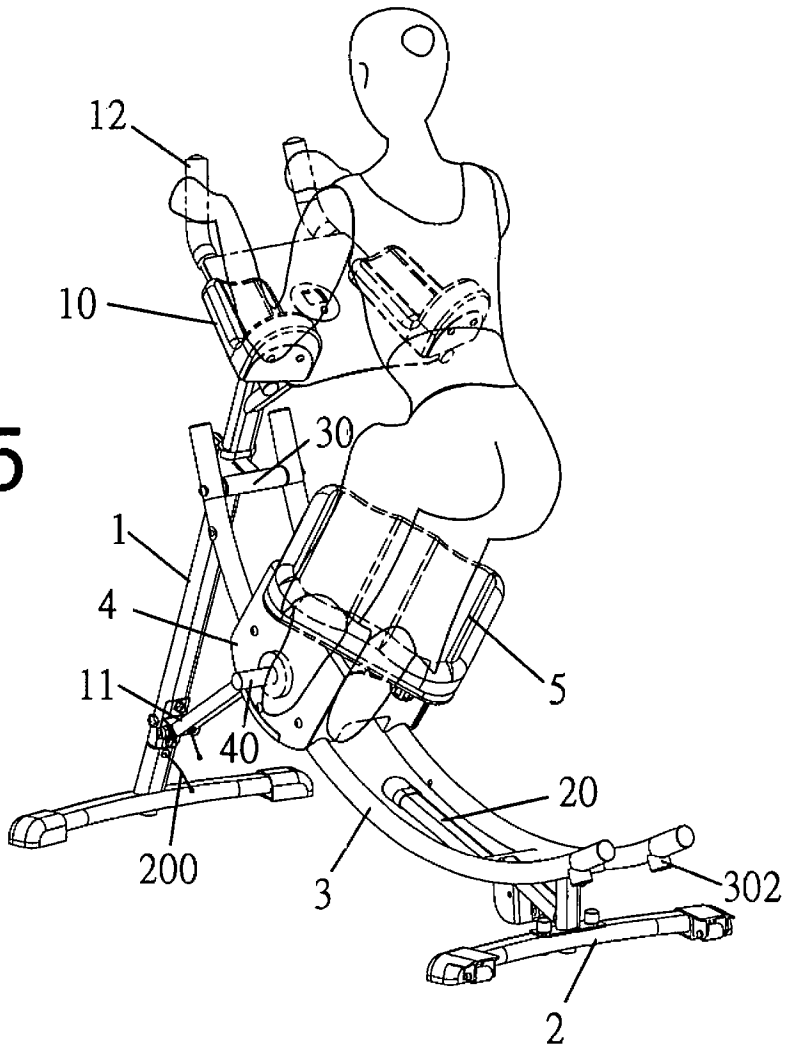
FIG. 5 is a schematic view of using a skateboarding fitness equipment in accordance with another preferred embodiment of the present invention.

With reference to the figures, the present invention provides a foldable skateboarding fitness equipment comprising a front support frame (1), a rear support frame (2), a dual-rail track bar (3), a cushion frame (4) and a cushion seat (5), wherein the dual-rail track bar (3) is formed in a circular arc shape having the cushion frame (4) slidably sheathed on the dual-rail track bar (3) by rollers (303); an adjusting knob (40) is provided for adjusting the friction of movement, and a turnable cushion seat (5) is pivotally coupled to the top of the cushion frame (4) by a ball bearing (41); the front support frame (1) has an elbow support cushion (10) and a handle (12) attached to both sides of the top of the dual-rail track bar (3) respectively. A link rod (11) is pivotally coupled between the bottom of the front support frame (1) and an intermediate portion of the dual-rail track bar (3). A pivoting base (30) slidably connects a front end of the dual-rail track bar (3) to the front support frame and the rear support frame (2) is attached to the rear end of the dual-rail track bar (3). The pivoting base 30 is provided for adjusting and slidably attaching to the front support frame (1) by a screw (100) so as to tilt the front support frame (1) with respect to the ground. A support leg (20) is pivotably installed onto the rear support frame (2). After the front support frame (1) is folded into the pivoting base (30), the support leg (20) can be secured in position to erect the frame (FIG. 3). In addition, a wire (200) installed between the top of the front support frame (1), the link rod (11) and the dual-rail track bar (3) is connected to a counter (201) and a counter starter (202).

Figure 1:
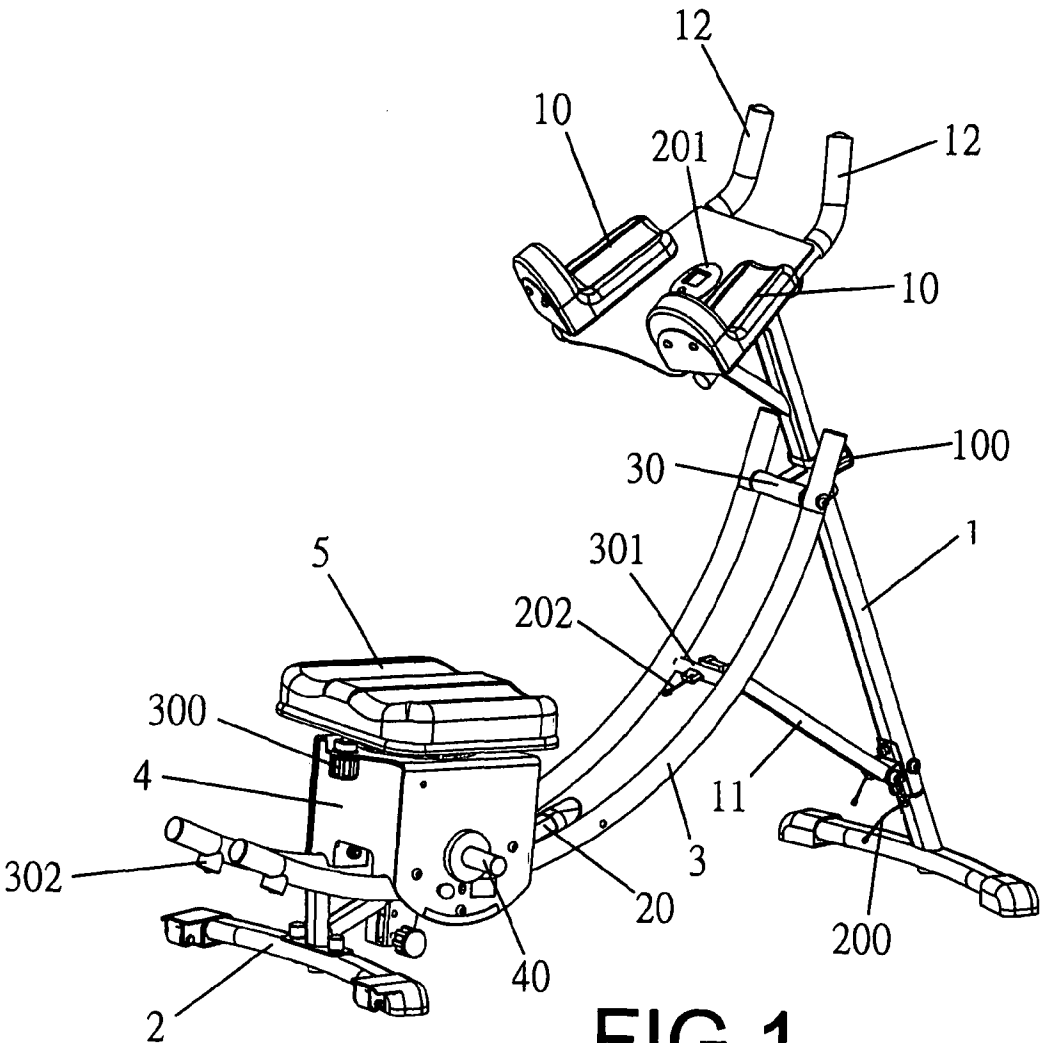
FIG. 1 is a perspective view of a preferred embodiment of the present invention.
Figure 2:
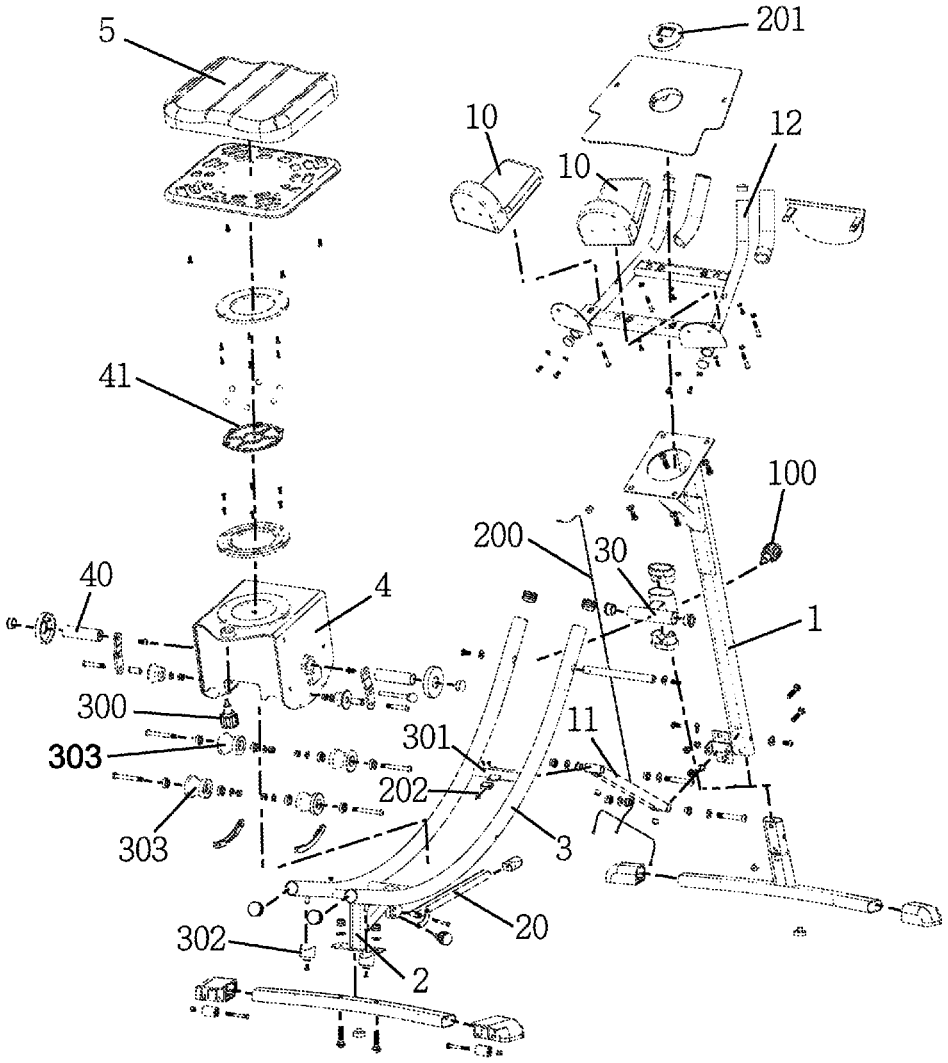
FIG. 2 is an exploded view of a preferred embodiment of the present invention.
Figure 6:
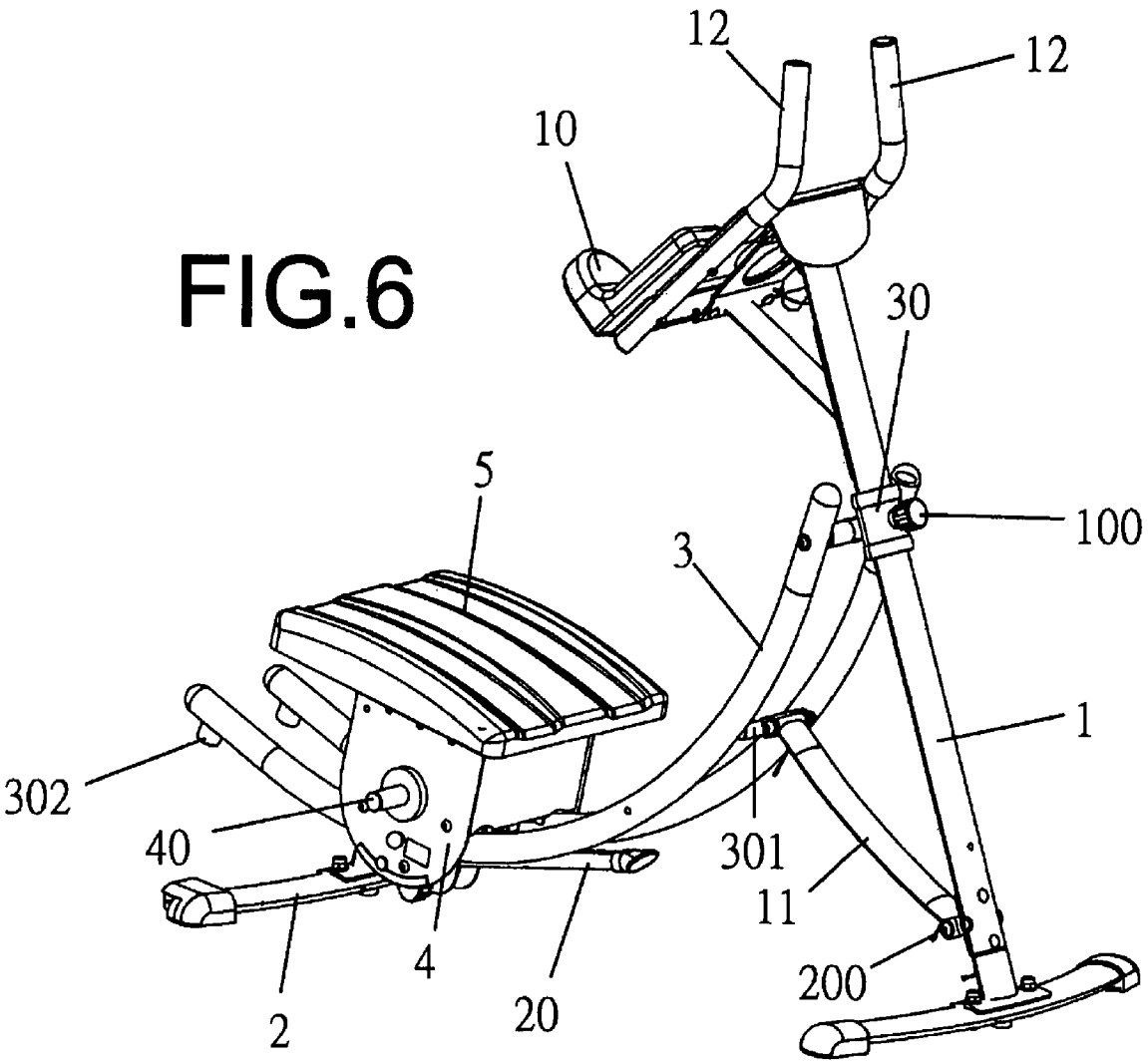
FIG. 6 is a perspective view of another preferred embodiment of the present invention.
Figure 7:
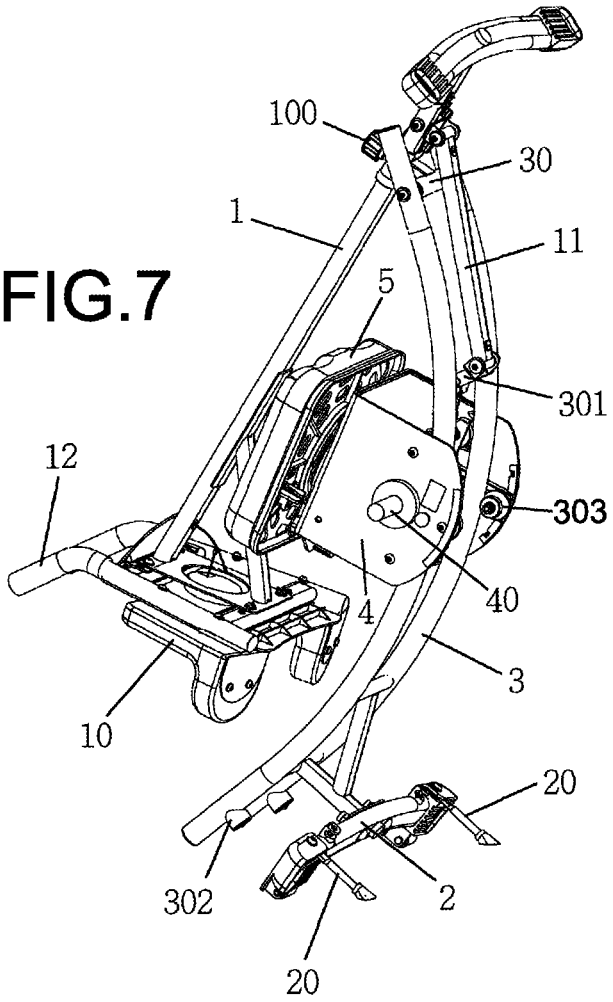
FIG. 7 is a perspective view of folding a skateboarding fitness equipment in accordance with another preferred embodiment of the present invention.

In an actual operation, a user can adjust the length of the front support frame (1) passing through the pivoting base (30) and secure it by a screw (100), thereby adjusting an inclination angle of the front support frame (1) (FIGS. 1 and 6). The rear support frame (2) at the rear end is provided for supporting the dual-rail track bar (3) with respect to the ground. Friction between the cushion frame (4) and the dual-rail track bar (3) can be adjusted, and the screw (300) is used for securing or loosening the connection between the cushion frame (4) and the cushion seat (5). A user can kneel on the cushion seat (5) and support their body by both elbows at the elbow support cushions (10), and use both knees, and the waist or abdomen to push the cushion seat (5) to drive the cushion frame (4) to slide the dual-rail track bar (3) back and forth. The waist and abdomen are contracted and bent to determine whether or not to rotate the cushion seat (5) to the right and the left. A stop member (301), (302) at an edge is provided for limiting the rotation of the cushion seat (5). This exercise simulates a skateboarding exercise to achieve the effect of training the user's waist, abdomen and hips, and provides different advanced levels of exercises for different users. In addition, a wire (200) is installed between the top of the front support frame (1), the link rod (11) and the top of the dual-rail track bar (3) such that after the wire (200) is connected, as the cushion frame (4) is moved forward to touch the counter starter (202), the counter (201) will display the number of times of slide movements. After the front support frame (1) is folded into the pivoting base (30), the support leg (20) can be secured in position to the rear support frame (2) and the rear end of the dual-rail track bar (3) to erect the foldable skateboarding fitness equipment, so as to reduce the storage volume thereof.

In summation of the description above, the present invention can achieve the effects of exercising the user's waist, abdomen and hips, providing different advanced levels of exercise for different users, and reducing the storage volume of the fitness equipment. In addition, the structure and device of the present invention have not been disclosed, and the invention complies with patent application requirements, and thus is duly applied for patent application.

While the invention has been described by means of specific embodiments, numerous modifications and variations could be made thereto by those skilled in the art without departing from the scope and spirit of the invention set forth in the claims.

What the invention claimed is:

1. A foldable skateboarding fitness equipment, comprising a front support frame, a rear support frame, a dual-rail track bar, a cushion frame and a turnable cushion seat, wherein the dual-rail track bar is in a circular arc shape having the cushion frame of the cushion seat slidably sheathed on the dual-rail track bar by rollers, an adjusting knob for adjusting friction of a sliding movement of the cushion frame on the dual-rail track bar, an elbow support cushion installed separately on both sides of the top of the dual-rail track bar, a pivoting base slidably attaching a front end of the dual-rail track bar to the front support frame, and a link rod pivotally coupled between the bottom of the front support frame and an intermediate portion of the dual-rail track bar, and the rear support frame being fixed to a rear end of dual-rail track bar.

2. The foldable skateboarding fitness equipment of claim 1, wherein the cushion frame includes a ball bearing installed at the top of the cushion frame for screwing and securing the turnable cushion seat.

3. The foldable skateboarding fitness equipment of claim 1, wherein the rear support frame includes a support leg pivotably attached to the rear support frame, such that the rear support frame and the support leg can support the foldable skateboarding fitness equipment in an erect position.

4. The foldable skateboarding fitness equipment of claim 1, further comprising a wire installed between the top of the front support frame, the link rod and the dual-rail track bar, and provided for connecting a counter.

* * * * *